US005632708A

United States Patent [19]

Wilkinson et al.

[11] Patent Number: 5,632,708

[45] Date of Patent: May 27, 1997

[54] RESISTANCE APPARATUS FOR EXERCISE EQUIPMENT

[76] Inventors: William T. Wilkinson, P.O. Box 378, Chesapeake City, Md. 21915; Ford B. Draper, Jr., 909 Nottingham Rd., Wilmington, Del. 19805

[21] Appl. No.: 549,917

[22] Filed: Oct. 30, 1995

Related U.S. Application Data

[62] Division of Ser. No. 359,345, Dec. 19, 1994, Pat. No. 5,476,431, which is a continuation of Ser. No. 130,776, Oct. 4, 1993, abandoned, which is a division of Ser. No. 818,350, Jan. 9, 1992, abandoned.

[51] Int. Cl.[6] ..... A63B 22/00

[52] U.S. Cl. ..... 482/52

[58] Field of Search ..... 482/51, 52, 53, 482/54, 130, 121–126, 129, 127

[56] References Cited

U.S. PATENT DOCUMENTS

| | | | |
|---|---|---|---|
| 605,237 | 6/1898 | Spink . | |
| 775,989 | 11/1904 | Roberts . | |
| 2,017,128 | 10/1935 | O'Neil | 482/54 |
| 3,642,279 | 2/1972 | Cutter . | |
| 3,833,216 | 9/1974 | Philbin . | |
| 4,373,716 | 2/1983 | Pagani . | |
| 4,538,804 | 9/1985 | Zibell . | |
| 4,705,269 | 11/1987 | DeBoer et al. . | |
| 4,779,867 | 10/1988 | Hinds . | |
| 4,798,377 | 1/1989 | White . | |
| 4,838,543 | 6/1989 | Armstrong et al. | 482/53 |
| 4,884,802 | 12/1989 | Graham . | |
| 4,921,247 | 5/1990 | Sterling . | |
| 5,013,035 | 5/1991 | Nathaniel | 482/121 |
| 5,112,287 | 5/1992 | Brewer | 482/130 |
| 5,178,591 | 1/1993 | Lyons | 482/52 |
| 5,230,676 | 7/1993 | Terands | 482/53 |
| 5,254,064 | 10/1993 | Rock | 482/54 |
| 5,405,305 | 4/1995 | Wilkinson et al. | 482/51 |

*Primary Examiner*—Stephen R. Crow
*Attorney, Agent, or Firm*—Connolly & Hutz

[57] ABSTRACT

Improved cycling apparatus is provided wherein the improvement comprises at least one elastic band, one end of which is affixed to the cycling apparatus at a desired location, the other end of the elastic band providing resistive force against exertion upon the band by one extremity of a user of the cycling apparatus. In a preferred embodiment, the cycling apparatus includes two elastic bands, one end of each elastic band being affixed to the frame of the apparatus, the other end of each elastic band having handle gripping means affixed thereto for gripping by the hands of the user. The bands provide resistive force against exertion upon these bands by the arms and hands of the user of the apparatus, thereby providing simultaneous, vigorous exercise for the arms, hands and upper body, as well as for the legs and lower body. In alternate embodiments, improved stair/step climbing and treadmill apparatus are provided, the improvement comprising at least one elastic band, one end of the elastic band being affixed to the apparatus at a desired location, the other end of the elastic band having handle gripping means affixed thereto for gripping by a hand of the user. Two elastic bands are preferred, one for each hand of the user. The bands provide resistive force against exertion upon the band by the arms and hands of the user of the apparatus resulting in simultaneous, vigorous exercise for both upper and lower body.

14 Claims, 8 Drawing Sheets

RESISTANCE APPARATUS FOR EXERCISE EQUIPMENT

This application is a divisional application of application Ser. No. 08/359,345 filed Dec. 19, 1994 now U.S. Pat. No. 5,476,431, which is a continuation of Ser. No. 08/130,776 filed Oct. 4, 1993 now abandoned, which is a division of Ser. No. 07/818,350 filed Jan. 9, 1992, now abandoned.

BACKGROUND OF THE INVENTION

The present invention relates to exercise apparatus. In particular, the invention relates to apparatus for simultaneously exercising both legs and both arms. The exercise apparatus is especially suited for use in combination with a bicycle, either a conventional bicycle ("bike") to be ridden outdoors, or to a stationary, indoor exercise bike. The invention is also suitable for use in combination with stair/step climbing exercise devices, for example, mechanical stair step climbing devices which generally are provided with a hand rail to be used for balance only, which rails provide virtually no exercise for the arms of the user. In addition, the invention is suitable for use in combination with a treadmill.

Conventional outdoor biking involves pedalling the bike with legs and feet to propel oneself across the terrain. The cyclist's arms are used to steer the bike, and the arms get little or no exercise during conventional cycling.

Stationary, indoor exercise bicycles are well known. Most of these devices provide exercise for the lower body, legs, only. Upper body exercise is known to increase heart rate and energy expenditure at a greater rate than lower body exercise. Maximum overall beneficial results are achieved by exercising both upper and lower body simultaneously, for example, in swimming, because exertion is spread over a larger muscle mass, resulting in moderation of rise in blood pressure.

Several exercise cycles are available which provide for exercising both upper and lower body. Prior patents also are directed to cycling apparatus which provides for exercising both upper and lower body. Several of these prior devices are described in U.S. Pat. No. 4,705,269, issued Nov. 10, 1987. That patent describes apparatus, including upper and lower body exercising assemblies, which are operable in isolation or in conjunction with each other. The upper body assembly includes rotary handle members which rotate a driving sprocket. The upper driving sprocket in turn rotates an upper driven sprocket which is connected via two additional sprockets and an endless chain to the wheel of the lower body exercising assembly. The lower body assembly is a conventional exercise bicycle including rotary foot pedals for rotating a lower driving sprocket which in turn rotates a lower driven sprocket connected to the wheel.

U.S. Pat. No. 4,798,377 discloses bicycling apparatus including a bicycle handle bar grip and handle mounted individually on the ends of a coil spring. The ends of the coil spring extend into the bicycle handle bar grip and handle longitudinally. The bicycle handle bar grip is equipped with a round longitudinal orifice to allow attachment to the end of any bicycle or stationary bicycle handle bar. When the bicycle handle bar grip is attached to a bicycle, the user or rider of the bicycle can exercise his or her hands by squeezing the handle toward the bicycle handle bar grip while simultaneously exercising the legs when riding.

Outdoor cycling may cover many types of terrain. Often the biker need not exert himself unduly, despite his seeking of exercise. This is especially true on a flat course or when cycling downhill.

There is a need, then, to increase the amount of exercise a biker can attain on any given ride, by means which are convenient, effective and inexpensive. The present invention provides apparatus for exercising both upper and lower body simultaneously to maximize the beneficial results achievable from such exercise.

SUMMARY OF THE INVENTION

Improved cycling apparatus is provided wherein the improvement comprises at least one elastic band, one end of the elastic band being affixed to the cycling apparatus at a desired location, the other end of the elastic band providing resistive force against exertion upon the band by one extremity of a user of the cycling apparatus.

Preferably, two elastic bands are provided, one end of each elastic band being affixed to the cycling apparatus at a desired location, the other end of each elastic band providing resistive force against exertion upon each band by each of two extremities of a user of the cycling apparatus. In one embodiment, one end of each elastic band is affixed to the cycling apparatus beneath the seat thereof and the other end of each elastic band is affixed, respectively, to each of the pedals of the bicycle.

Alternatively, the other end of each elastic band may be affixed to each of the lower legs at the feet or ankles of a user of the cycling apparatus.

In a further embodiment, the apparatus is of the stationary, indoor, exercise type, and the improvement comprises two elastic bands, one end of each elastic band being affixed to the frame of the apparatus, the other end of each elastic band having handle gripping means affixed thereto for gripping by the hands of the user. The bands provide resistive force against exertion upon the bands by the arms and hands of the user of the apparatus, thereby providing simultaneous upper and lower body exercise.

An inelastic band passing through friction brake means mounted at a desired location on the apparatus may also provide resistive force against exertion upon the band by the arms and hands of the user pulling the band back and forth through the friction brake means.

The elastic bands according to the invention may also be used in combination with stair climbing apparatus or treadmill apparatus to provide simultaneous exercise for both upper and lower body.

BRIEF DESCRIPTION OF THE INVENTION

Figure 3:
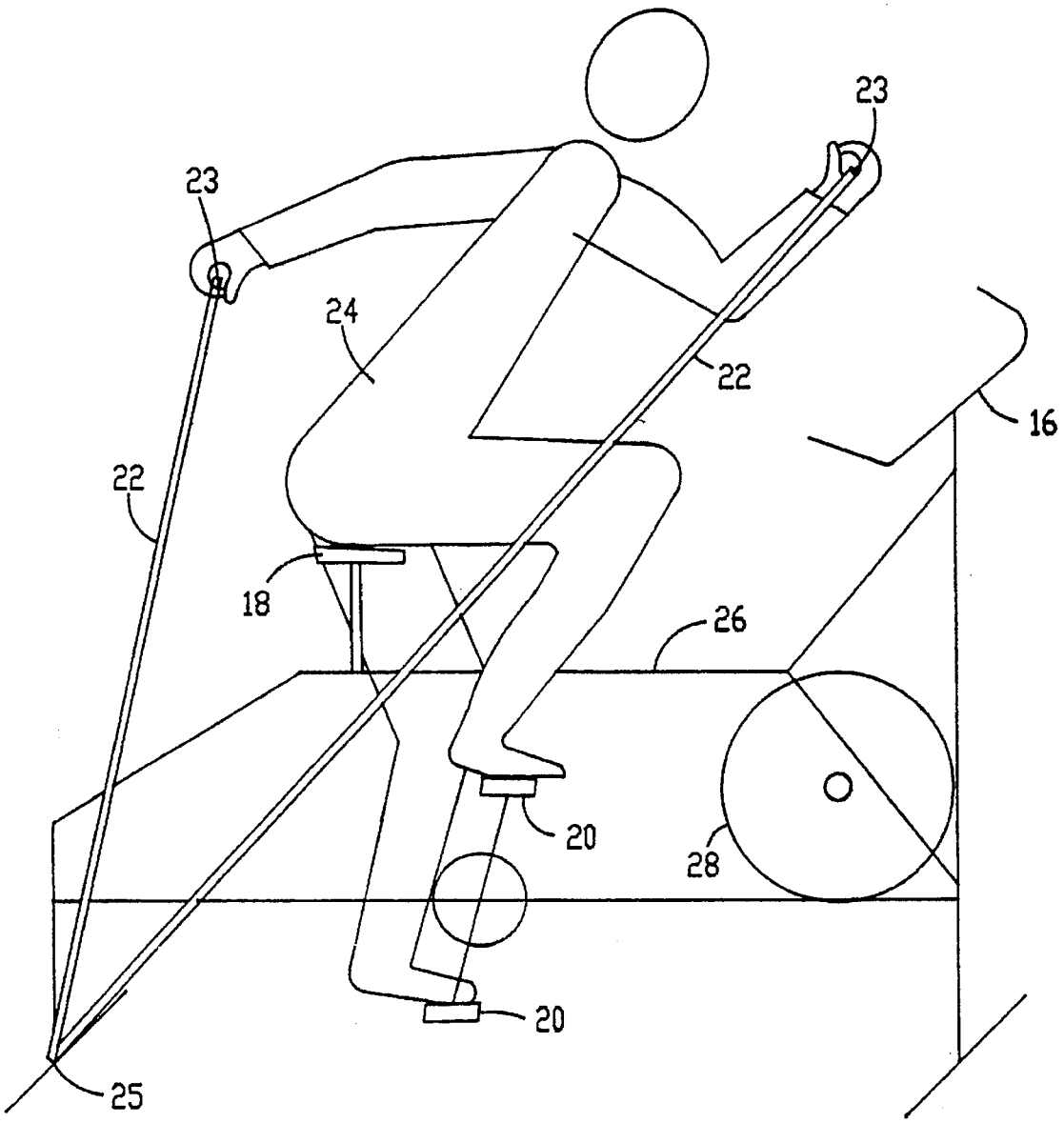

FIG. 3 schematically depicts a rider on a stationary exercise bicycle equipped with elastic bands according to the invention wherein one end of each band is anchored at the rear base frame of the apparatus and the other end of each band is equipped with handles which are gripped by the rider and pulled repeatedly to provide arm and upper body exercise.

Figure 4:
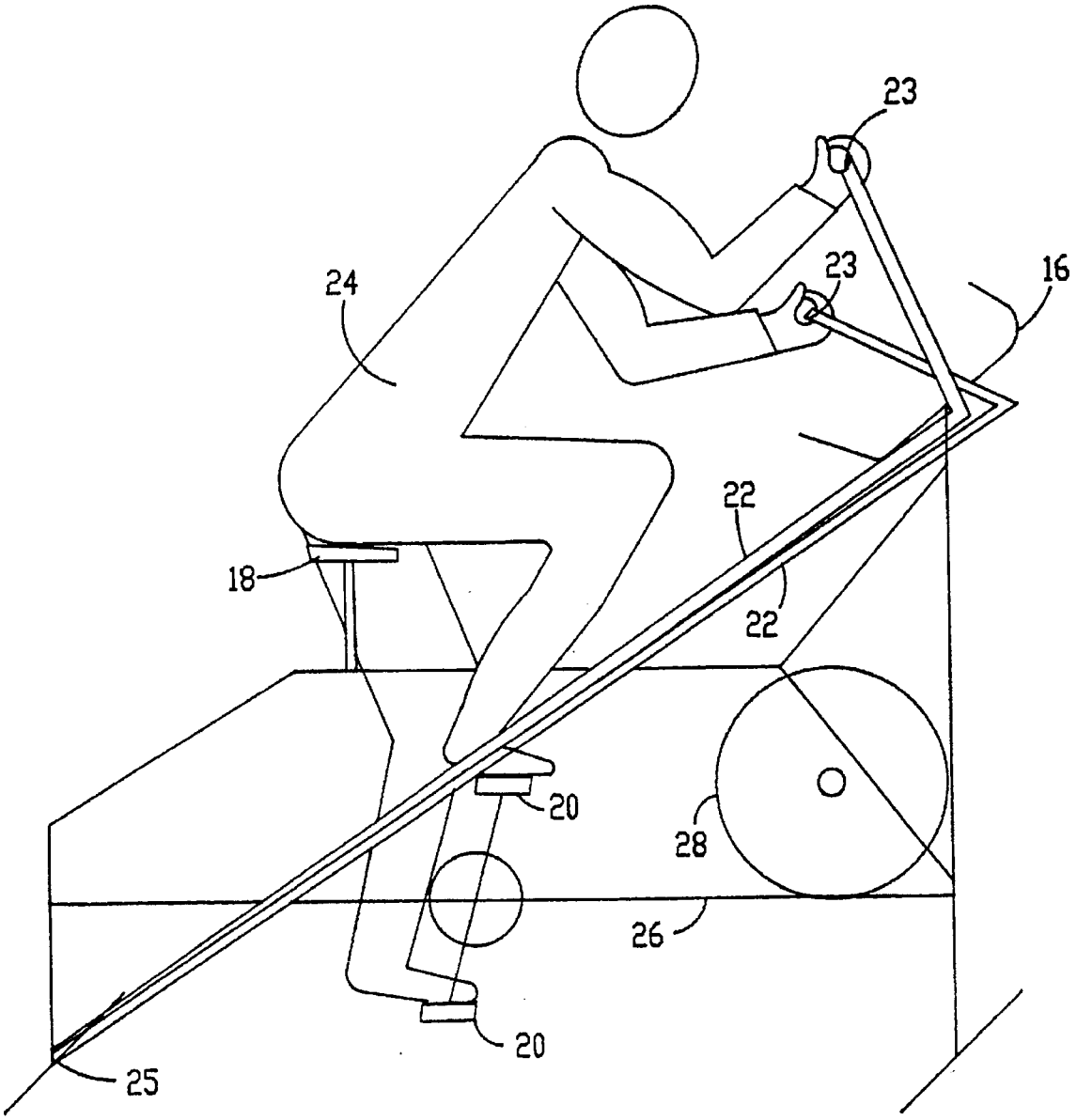

FIG. 4 depicts the exercise apparatus shown in FIG. 3 wherein the elastic bands are disposed under the handlebar to provide a different mode of exercise for the user.

Figure 5:
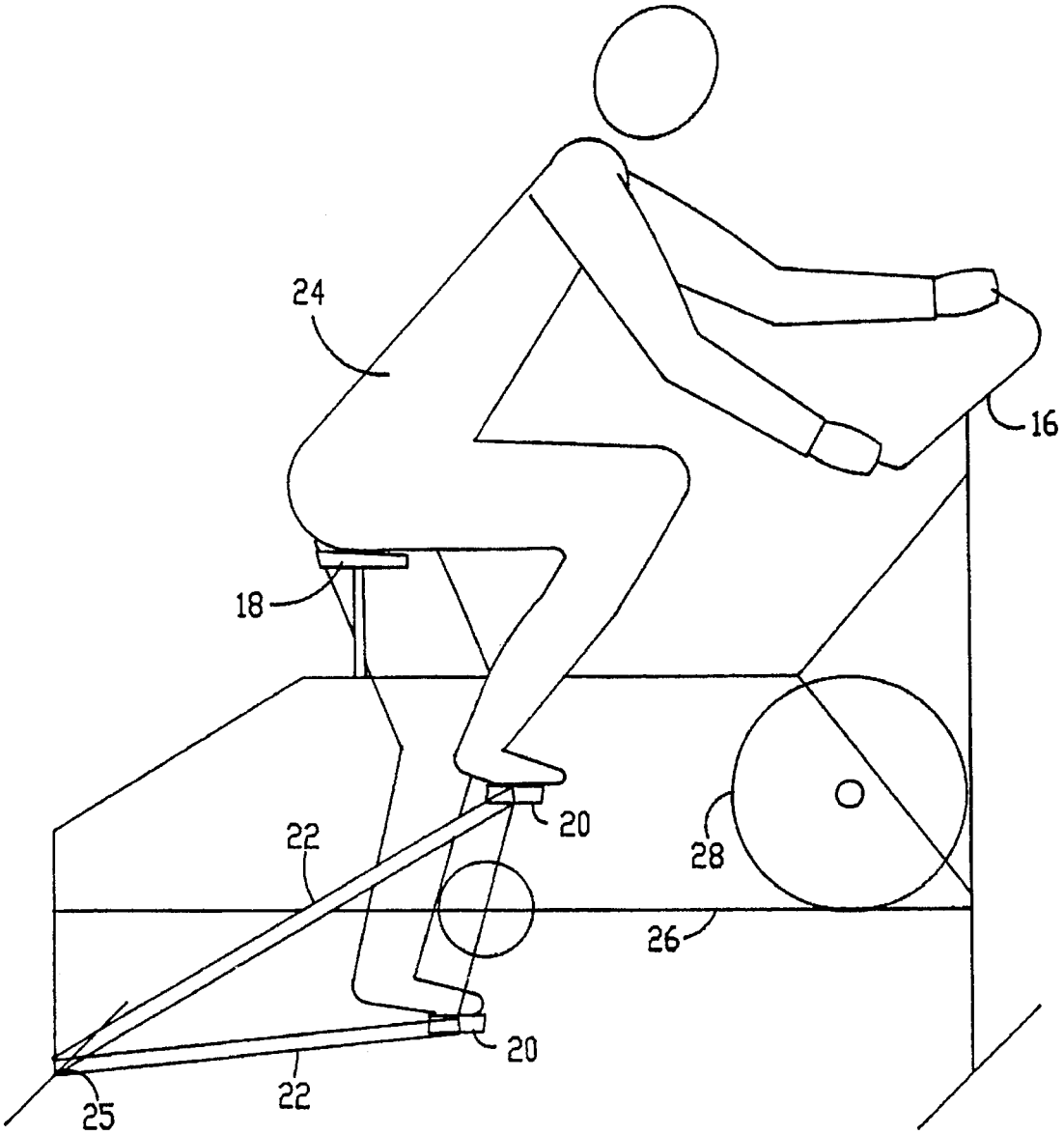

FIG. 5 schematically depicts the elastic bands anchored to the rear frame of the apparatus and extending to the pedals so as to increase the resistive force against pedalling.

Figure 6:
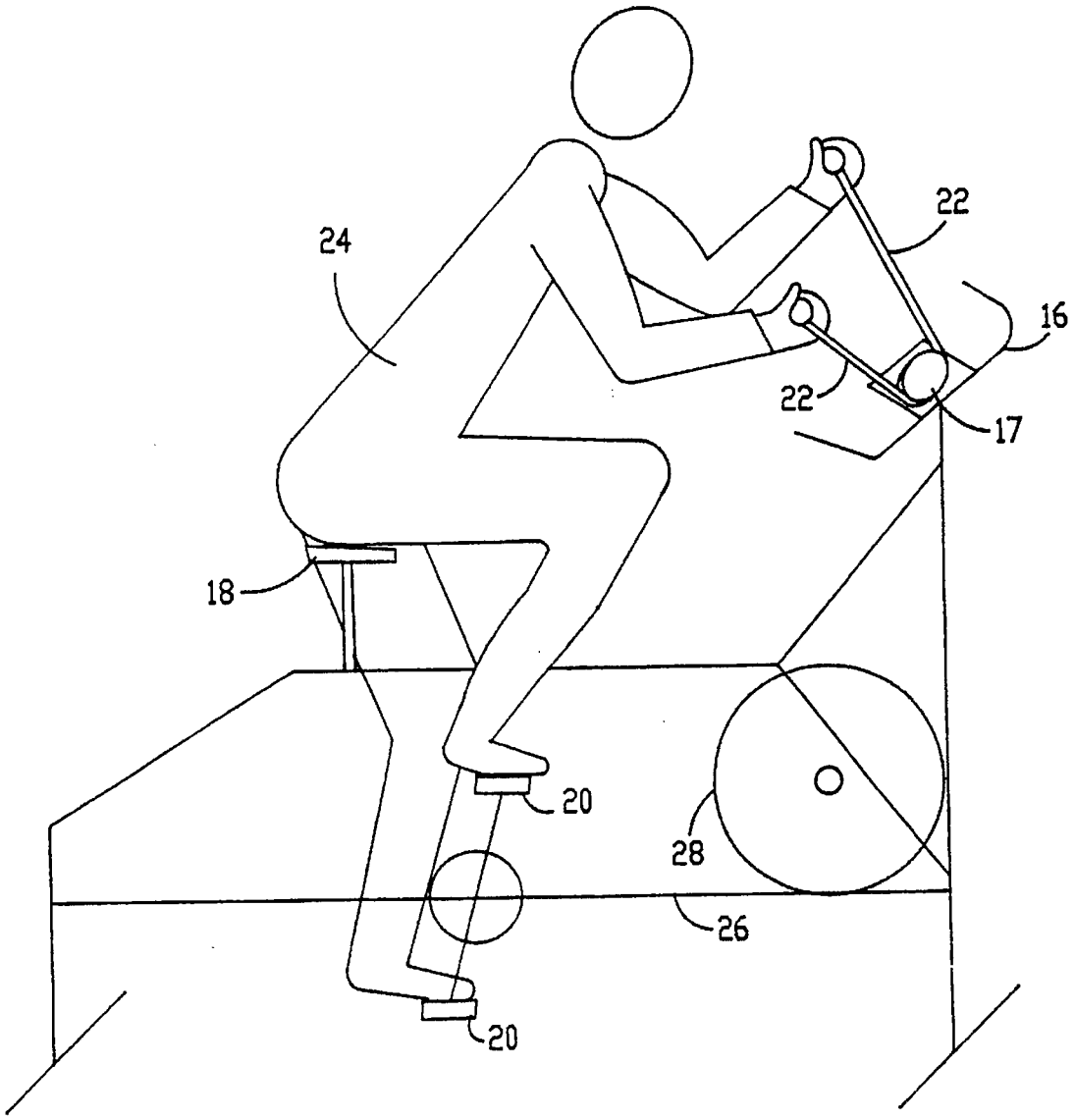

FIG. 6 is a schematic diagram of a stationary exercise bicycle having a friction brake mechanism affixed to the handlebar and having an inelastic band or cord running therethrough such that the rider may exercise his arms and upper body by pulling the cord back and forth through the brake mechanism.

Figure 7:
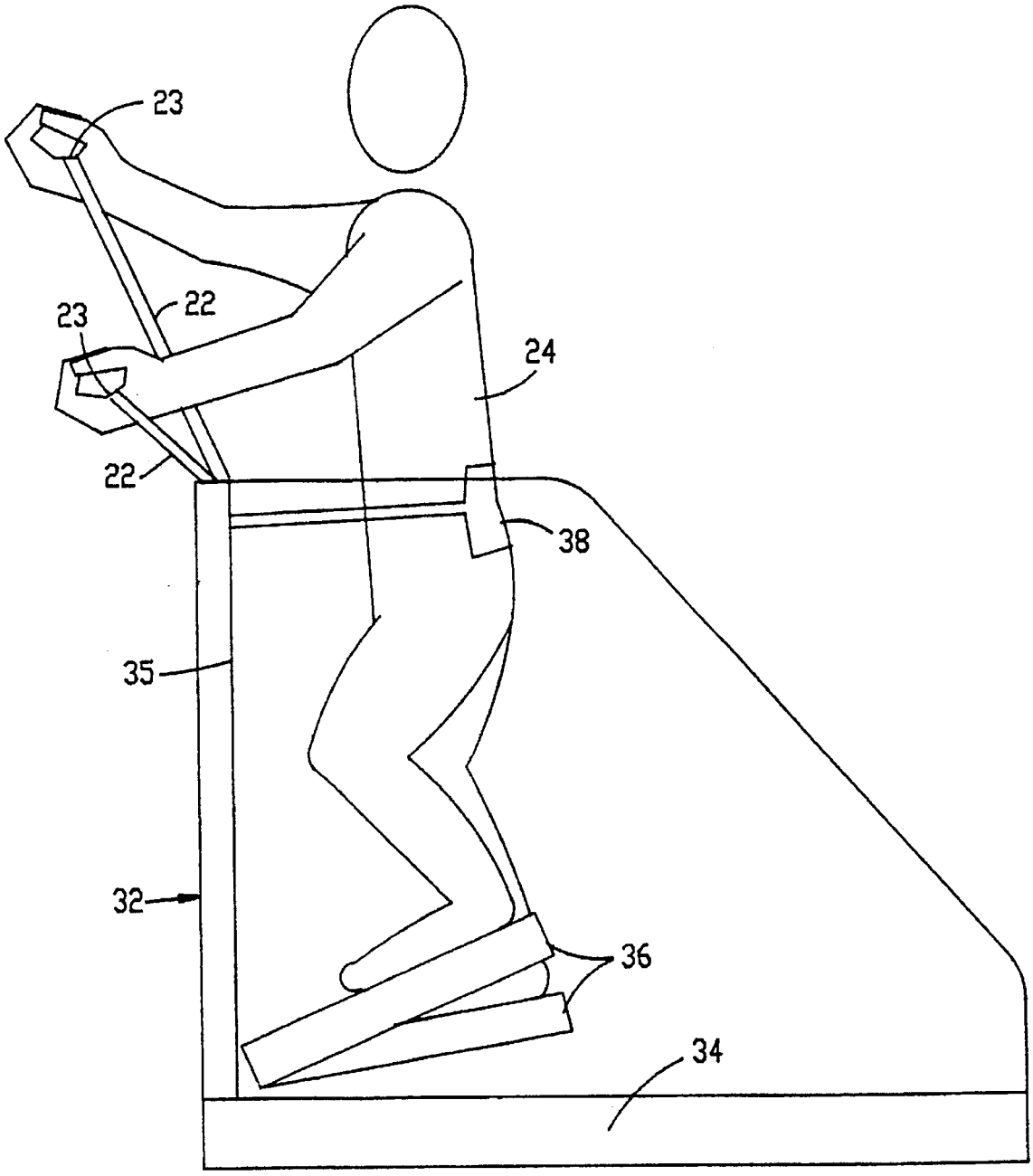

FIG. 7 schematically depicts simulated stair step climbing apparatus wherein elastic bands affixed to the forward frame enable the user to exercise his arms as shown, the belt encircling the user being provided for stability.

Figure 8:
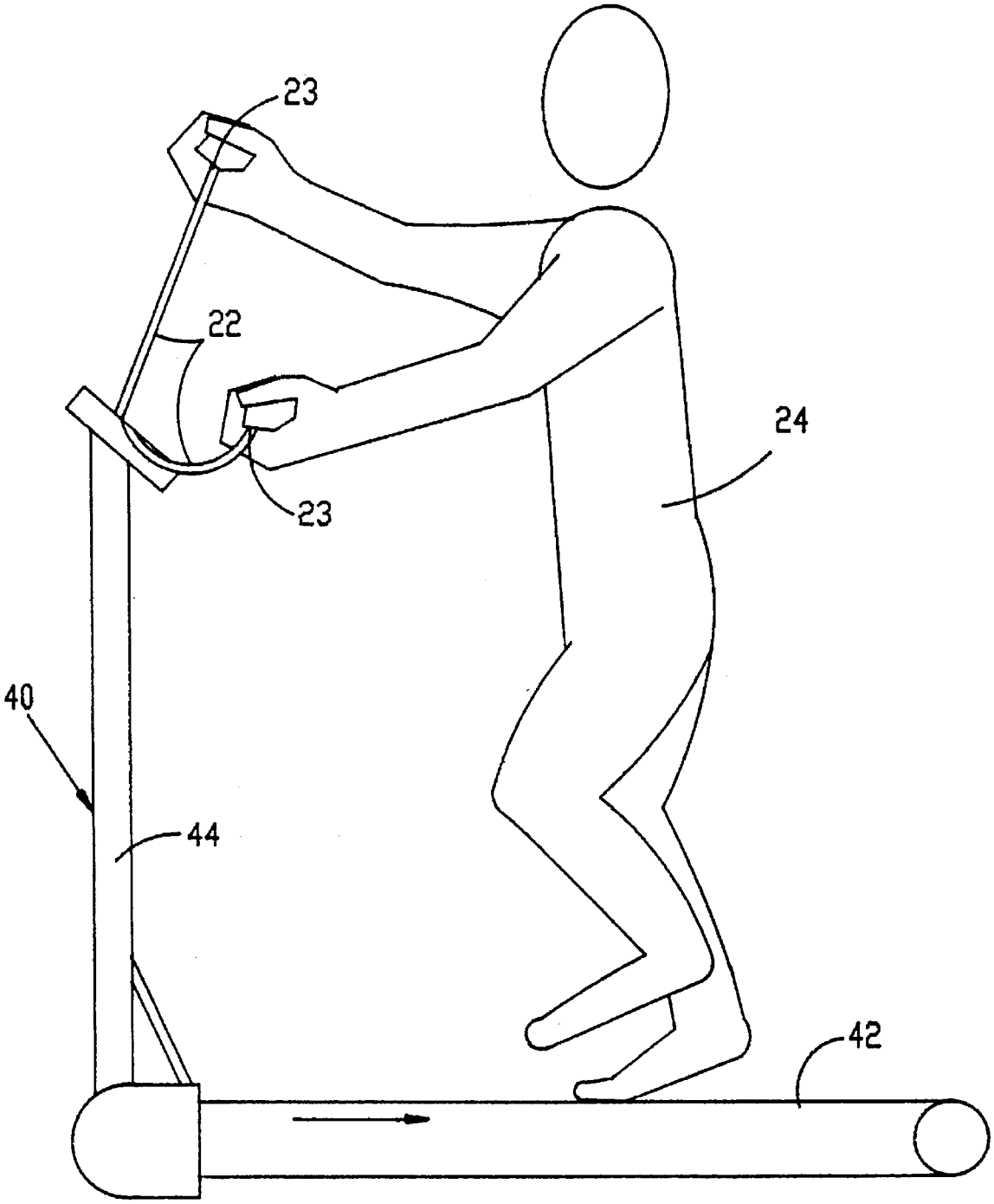

FIG. 8 schematically depicts treadmill apparatus wherein elastic bands affixed to the frame enable the user to exercise his arms as shown.

DETAILED DESCRIPTION OF THE INVENTION AND PREFERRED EMBODIMENTS WITH REFERENCE TO THE DRAWINGS

Improved cycling apparatus is provided wherein the improvement comprises at least one elastic band, one end of which is affixed to the cycling apparatus at a desired location, the other end of the elastic band providing resistive force against exertion upon the band by one extremity of a user of the cycling apparatus. In a preferred embodiment, the cycling apparatus includes two elastic bands, one end of each elastic band being affixed to the frame of the apparatus, the other end of each elastic band having handle gripping means affixed thereto for gripping by the hands of the user. The bands provide resistive force against exertion upon these bands by the arms and hands of the user of the apparatus, thereby enabling the apparatus to provide simultaneous exercise for the arms, hands and upper body, as well as for the legs and lower body. In alternate embodiments, improved stair/step climbing and treadmill apparatus are provided, the improvement comprising at least one elastic band, one end of the elastic band being affixed to the apparatus at a desired location, the other end of the elastic band having handle gripping means affixed thereto for gripping by a hand of the user. The band provides resistive force against exertion upon the band by the arm and hand of the user of the apparatus resulting in simultaneous exercise for both upper and lower body.

The invention provides a convenient and economical method by which all bikers can increase the effort needed to bike and, thus, increase the amount of their exercise. The biker can get more exercise in less time. This is generally accomplished by one or more elastic bands/cords being attached to the pedals or to the biker's legs/feet/shoes, while the other end of the band is attached to some part of the bike, e.g., the frame, axle, wheels, seat or handlebars. The band(s) also could be attached to the rider. The bands can be of a fixed length or they can be adjustable. The bands may also be nonelastic, and resistance may be provided by a pulley and friction brake mechanism. The band/cords may be detachable or they may be permanently affixed to a bike. Also, bands may be of different strength/tension so that a biker could vary the resistance as desired.

In a preferred form, two bands are attached to the back of the pedals of a conventional bike, and the other ends are affixed underneath the seat. As the biker pedals, he must pedal harder to overcome the extra resistance of the elastic cords and he thus gets more exercise. The bands are easily detached when regular, less vigorous pedalling is desired.

Another popular form of cycling is performed indoors on stationary exercise bicycles. The biker can adjust the tension/resistance against his legs to achieve different levels of exercise. However, indoor cycling, like outdoor cycling, is not "total" exercise, because the upper body and arms are not exercised.

There is, then, a need in bicycling to exercise the arms so that the biker can get more exercise in less time, and also so that the biker can get a more "total" workout involving the upper body.

As stated, the invention involves the use of an elastic band(s) that is attached to/grasped by the user's hands. The other end(s) can be attached to some part of the indoor exercise bike, e.g., frame, seat, handlebars or pedals.

While at rest or pedalling, the user can also perform various pumping/pulling arm exercises in part or where the end of the cord is attached.

In a preferred embodiment, an elastic band is grasped in each hand of the user with ends attached at the back base of the bike. The arms are then pumped up and down or, if the bands are run forwardly through the handlebars and back to the user, pumped in a back and forth motion.

The invention enhances either an indoor or outdoor bike workout and, at the same time, helps to relieve boredom.

Figure 1:
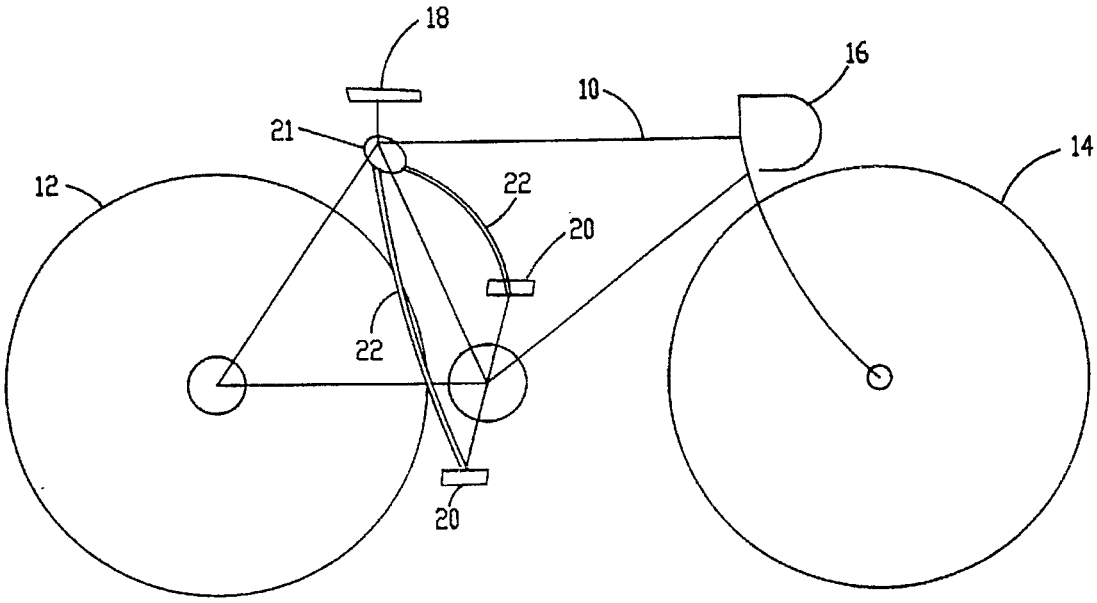
FIG. 1 is a schematic view of a conventional outdoor bicycle equipped with the resistive bands of the invention in such a way as to increase the resistive force against pedalling.

A detailed description of the invention and preferred embodiments is best provided with reference to the drawings wherein FIG. 1 is a schematic representation of a conventional bicycle equipped with the bands according to the invention. The bicycle depicted in FIG. 1 includes frame 10, rear wheel 12, front wheel 14, handlebar 16, seat 18 and pedals 20. The elastic bands or cords 22 according to the invention are affixed at their one end beneath seat 18 by fastening means 21 and each is affixed at their other end to a respective pedal 20, as shown. As the bicycle is pedalled, the elastic bands 22, in their stretched state, exert an additional resistive force against pedalling, thereby increasing the force required to propel the bicycle and increasing the amount of energy expended and exercise acquired.

Elastic bands or cords 22 may be of any suitable elastic material. Bungee cords, rubber bands, shock cords or coiled elastic metal springs are all possibilities.

Figure 2:
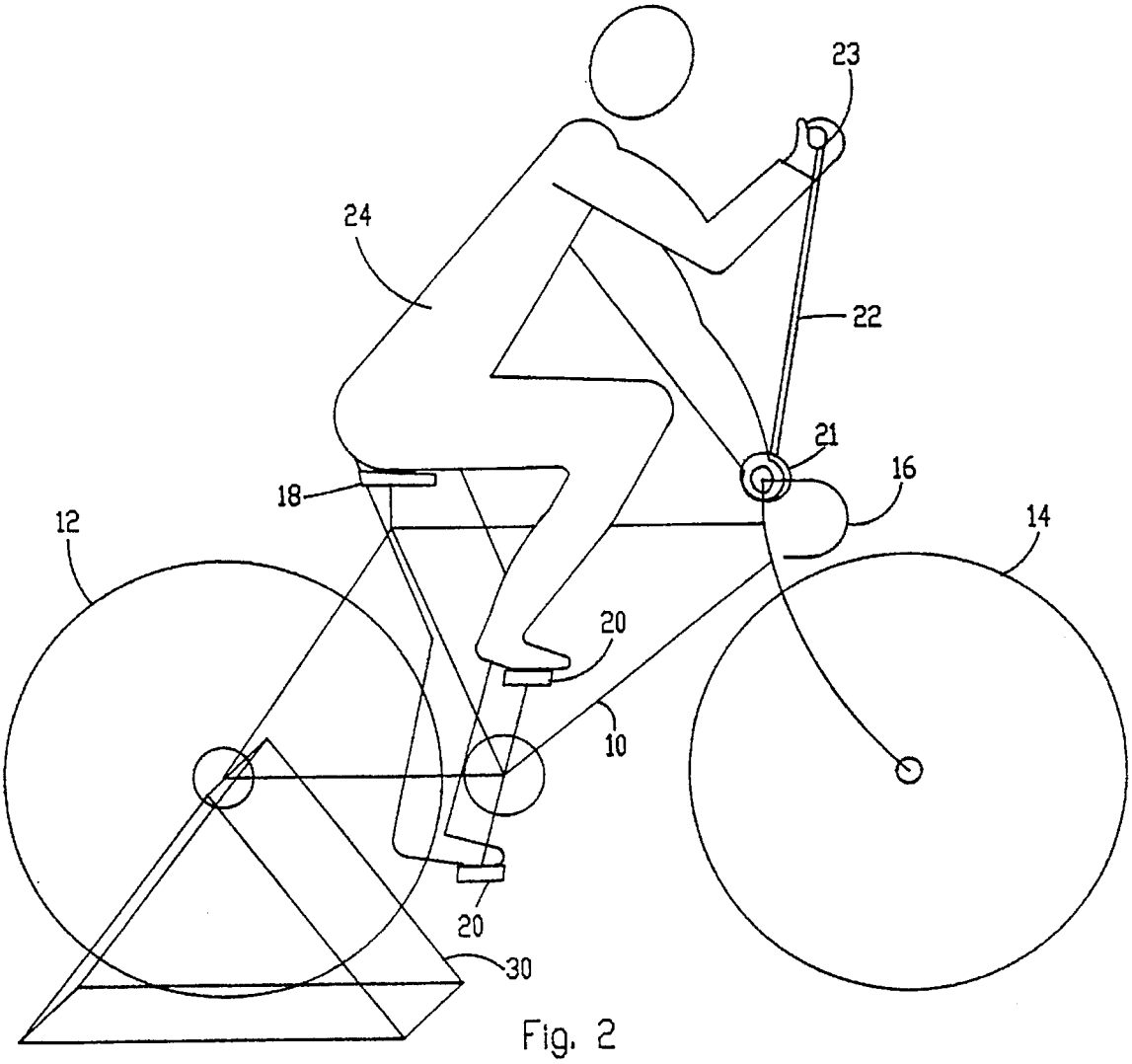
FIG. 2 is a schematic view of a conventional bike placed in blocks such that the rear wheel spins upon pedalling, but the bicycle does not move forward, and wherein resistive bands are affixed to the handlebar providing for arm and hand exercise upon pulling, as shown.

FIG. 2 shows a conventional bicycle with its rear wheel placed in blocks 30 so that it may be used as a stationary exercise bicycle. Pedalling will turn rear wheel 12 against a set resistance, but the bicycle will remain stationary and not move forward. In FIG. 2, the bands 22 of the invention are affixed at their one end to handlebar 16 by fastening means 21. Handles 23 at the other end of bands 22 are gripped by the rider. While pedalling the bicycle, the rider gains arm and upper body exercise simultaneously by repeatedly pulling on bands 22.

FIG. 3 shows the elastic bands of the invention adapted to an indoor, stationary exercise bicycle. The exercise bicycle is schematically represented by frame 26 and resistance wheel 28 which rotates against an adjustable resistance mechanism by pushing pedals 20. The bands 22 of the invention are fastened at their one end at the lower rear of frame 26 by anchor means 25. Handle gripping means 23 at the other end of each band 22 are gripped by rider 24, and repeated pulling on these bands by the rider while cycling provides both upper and lower body exercise, i.e., total body exercise.

FIG. 4 shows an alternate embodiment of use of the bands of the invention with a stationary exercise bike. In this embodiment, the bands 22 are passed under the handlebar 16 as shown and present a pulling mode of exercise for rider 24. Again, repeated pulling on bands 22 while pedalling provides simultaneous upper and lower body exercise.

FIG. 5, like FIG. 1 using an outdoor bicycle, depicts adaption of bands 22 to a stationary bike in a manner to increase the resistance to pedalling.

FIG. 6 depicts an alternate embodiment wherein band 22, which may be inelastic, is passed through adjustable friction brake means 17, whereby back and forth pulling of band 22 provides a still further mode of upper body and arm exercise while simultaneously cycling.

FIG. 7 depicts a still further embodiment of the elastic bands of the invention adapted to fit a simulated stair step climbing apparatus, generally shown as 32. The apparatus 32 has base 34 and frame 35 and steps 36. Attached to the frame 35 are the elastic bands 22 of the invention which, when repeatedly pulled while "climbing" the stairs, provide simultaneous upper and lower body exercise. Belt 38, attached to frame 35, encircles the user 24 and provides balance and stability.

FIG. 8 depicts a further embodiment of the elastic bands of the invention adapted to fit a treadmill apparatus 40. The apparatus 40 has a moving treadmill 42 as indicated by the arrow, and frame 44. Attached to the frame 44 are the elastic bands 22 of the invention which, when repeatedly pulled while walking or running on the treadmill, provide simultaneous upper and lower body exercise.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A method of performing foot and arm exercises standing on a stepping apparatus comprising a user standing on said stepping apparatus wherein said stepping apparatus comprises a frame, a pair of steps connected to said frame and at least one elastic band, one end of said elastic band being affixed to said stepping apparatus and the other end of said elastic band being free to grasp by a user:

placing the user's feet on said steps whereby said user pushes said steps with said feet to move said steps in an up and down motion; and at the same time said user grips one end of said band with said user's hand and said user pulls upwardly on said band to stretch to a desired length against the resistance of said elastic band and then allows the band to contract back to the original position wherein the band pulls the user's hand toward the end of said band affixed to said stepping apparatus and the user repeats the stretching and contraction of said band and the stepping on the steps until the user has achieved the desired workout.

2. The method as claimed in claim 1, wherein there are two elastic bands connected to said stepping apparatus and the user grips in one hand one end of said band and each of the user's hands has a different band.

3. The method as claimed in claim 2, wherein the stepping apparatus further comprises a belt attached to said frame, whereby the belt can encircle the user and provide balance and stability.

4. The method as claimed in claim 1, wherein the user pulls said band toward the user while facing said stepping apparatus.

5. The method as claimed in claim 1, wherein said end of said band which is affixed to the stepping apparatus is affixed at a position below the user's shoulders but above the user's waist when the user is standing on said stepping apparatus.

6. In an improved method of performing exercising by a user standing on the steps of a stepping apparatus, wherein said stepping apparatus comprises a frame, a step assembly mounted to said frame and said step assembly comprises a pair of steps the improvement being in providing at least one elastic band, affixing one end of said elastic band to said frame and the other end of said elastic band being free to grasp by a user, placing the user's feet on said steps, the user moving said steps with the user's feet, the user gripping said elastic band with the user's hands, the user pulling said band to stretch said band in opposition to a resistive force against exertion upon said band the user permitting the band to contract, and repeatedly stretching and contracting the band while stepping on the step assembly with the user's feet to simultaneously perform leg and arm exercises.

7. The method as claimed in claim 6, wherein there are two elastic bands, one end of each of said elastic bands being affixed to said stepping apparatus at a desired location, and the other end of each said elastic bands being gripped by the user's hands having one end of each of said bands in a different hand.

8. The method as claimed in claim 7, wherein the stepping apparatus further comprises a belt attached to said frame, whereby the belt can encircle the user and provide balance and stability.

9. The method as claimed in claim 6, wherein the user pulls said band toward the user while facing said stepping apparatus.

10. The method as claimed in claim 6, wherein said end of said band which is affixed to the stepping apparatus is affixed at a position below the user's shoulders but above the user's waist when the user is standing on said stepping apparatus.

11. A method of performing foot and arm exercises standing on a stepping apparatus comprising a user standing on said stepping apparatus wherein said stepping apparatus comprises a frame, a pair of steps connected to said frame and at least one elastic band, one end of said elastic band being affixed to said stepping apparatus and the other end of said elastic band being free to grasp by a user:

placing the user's feet on said steps whereby said user pushes said steps with said feet to move said steps in an up and down motion; and at the same time said user grips one end of said band with said user's hand; the other end of said band is affixed to the stepping apparatus at a position below the user's shoulders but above the user's waist when the user is standing on said stepping apparatus and said user pulls upwardly on said band to stretch to a desired length against the resistance of said elastic band and then allows the band to contract back to the original position wherein the band pulls the user's hand toward the end of said band affixed to said stepping apparatus and the user repeats the stretching and contraction of said band and the stepping on the steps until the user has achieved the desired workout.

12. The method as claimed in claim 11, wherein the user pulls said band toward the user while standing on said steps and facing said frame of said stepping apparatus.

13. The method as claimed in claim 11, wherein there are two elastic bands connected to said stepping apparatus and the user grips in one hand one end of said band and each of the user's hands has a different band.

14. The method as claimed in claim 13, wherein the stepping apparatus further comprises a belt attached to said frame, whereby the belt can encircle the user and provide balance and stability.

* * * * *